US011617490B2

(12) United States Patent
Heidel et al.

(10) Patent No.: US 11,617,490 B2
(45) Date of Patent: Apr. 4, 2023

(54) DISHWASHER, METHOD FOR OPERATING A DISHWASHER, AND COMPUTER PROGRAM PRODUCT

(71) Applicant: BSH Hausgeräte GmbH, Munich (DE)

(72) Inventors: Andreas Heidel, Holzheim (DE); Sebastian Wagner, Glött (DE); Bernd Kränzle, Dischingen (DE)

(73) Assignee: BSH Hausgeräte GmbH, Munich (DE)

( * ) Notice: Subject to any disclaimer, the term of this patent is extended or adjusted under 35 U.S.C. 154(b) by 154 days.

(21) Appl. No.: 17/041,468

(22) PCT Filed: Apr. 12, 2019

(86) PCT No.: PCT/EP2019/059366

§ 371 (c)(1),
(2) Date: Sep. 25, 2020

(87) PCT Pub. No.: WO2019/197591

PCT Pub. Date: Oct. 17, 2019

(65) Prior Publication Data

US 2021/0121038 A1 Apr. 29, 2021

(30) Foreign Application Priority Data

Apr. 12, 2018 (DE) ..... 10 2018 205 524.6

(51) Int. Cl.
*A47L 15/00* (2006.01)
*A47L 15/42* (2006.01)

(52) U.S. Cl.
CPC ..... *A47L 15/0063* (2013.01); *A47L 15/4293* (2013.01); *A47L 2301/08* (2013.01); *A47L 2401/03* (2013.01)

(58) Field of Classification Search
CPC ..... A47L 15/0063; A47L 15/4293; A47L 15/4295; A47L 2301/08; A47L 2401/03
(Continued)

(56) References Cited

U.S. PATENT DOCUMENTS 7,021,204 B2 * 4/2006 Backus ..... A47J 37/041 99/339
9,510,723 B2 * 12/2016 Cottrell ..... A47L 15/0063
(Continued)

FOREIGN PATENT DOCUMENTS

DE 102016203095 A1 8/2017
WO 2012031904 A1 3/2012
WO 2013021330 A1 2/2013

OTHER PUBLICATIONS

National Search Report DE102018205524.6 dated Jan. 3, 2019.
International Search Report PCT/EP2Q19/059366 dated May 21, 2019.

*Primary Examiner* — Christopher Remavege
(74) *Attorney, Agent, or Firm* — Michael E. Tscupp; Andre Pallapies; Brandon G. Braun

(57) ABSTRACT

A dishwasher includes a memory unit for storing a number of washing programs, a control device configured to carry out a washing program from the number of washing programs; and a communication unit configured to retrieve a specific washing program from an external device in accordance with a status information relating to an external household appliance, and to store the retrieved specific washing program in the memory unit, said control device carrying out the stored specific washing program.

15 Claims, 4 Drawing Sheets

(58) Field of Classification Search
USPC ..... 134/18
See application file for complete search history.

(56) References Cited

U.S. PATENT DOCUMENTS

| | | | | |
|---|---|---|---|---|
| 9,924,849 | B2 * | 3/2018 | Gary, Jr. | A47L 15/46 |
| 10,285,559 | B2 * | 5/2019 | Heiligenmann | A47L 15/449 |
| 2008/0140862 | A1 * | 6/2008 | Elston | H04L 12/2825 709/248 |
| 2010/0102076 | A1 * | 4/2010 | Hendrickson | D06F 39/02 221/9 |
| 2014/0180847 | A1 * | 6/2014 | Silverstein | G09B 19/00 705/15 |
| 2014/0241354 | A1 * | 8/2014 | Shuman | H04L 12/2803 370/390 |
| 2014/0362991 | A1 * | 12/2014 | Ebrom | H04W 12/64 380/270 |
| 2014/0379860 | A1 | 12/2014 | Bröcker et al. | |
| 2017/0079501 | A1 * | 3/2017 | Heiligenmann | H04L 12/2827 |

* cited by examiner

DISHWASHER, METHOD FOR OPERATING A DISHWASHER, AND COMPUTER PROGRAM PRODUCT

CROSS-REFERENCES TO RELATED APPLICATIONS

This application is the U.S. National Stage of International Application No. PCT/EP2019/059366, filed Apr. 12, 2019, which designated the United States and has been published as International Publication No. WO 2019/197591 A1 and which claims the priority of German Patent Application, Ser. No. 10 2018 205 524.6 filed Apr. 12, 2018, pursuant to 35 U.S.C. 119(a)-(d).

BACKGROUND OF THE INVENTION

The present invention relates to a dishwasher, a method for operating a dishwasher, and a computer program product.

Many conventional household appliances have components or assemblies that need to be washed as part of regular care, so the household appliance can perform its envisioned function unimpaired. For example, regularly checking the filter inserts, and cleaning them if they are contaminated, is envisioned in the case of a fume extractor hood.

The components in question in this regard contain in particular various materials, with the result that correct care, and in particular correct washing where the component is not damaged or even destroyed, needs to be observed. It is particularly advantageous and desirable for users not to have to undertake cleaning of the components by hand, but instead to have them cleaned like regular washing-up in an existing dishwasher. Conventional washing programs are not adapted to the specific requirements of various such components however, so that the components can often be damaged in the course of this.

BRIEF SUMMARY OF THE INVENTION

Given this background, an object of the present invention is to make an improved dishwasher available.

According to a first aspect, a dishwasher, more particularly a household dishwasher, comprising a memory unit for storing a number of washing programs, a control device for carrying out a washing program from the number of washing programs, and a communication unit, is proposed. The communication unit is designed to retrieve a specific washing program from an external device in accordance with status information relating to an external household appliance, and to store the retrieved specific washing program in the memory unit. The control device is designed to carry out the stored specific washing program.

This dishwasher has the advantage in particular that a specific washing program can be made available for every component, that needs cleaning, of a household appliance present in the household of the user of the dishwasher for example. An optimal washing outcome, taking account of special requirements of the components, can therefore be achieved. In particular this makes it possible to avoid the risk of such a component being damaged or destroyed by an unsuitable washing program. A component of an external household appliance is understood to mean in particular any element that can be used in such an external household appliance. For example this can be a back plate or a grill rack for an oven, a glass turntable for a microwave, a filter insert for a fume extractor hood, a water tank and/or a coffee holder of a coffee machine, or even a strainer insert of a deep fryer.

While the communication unit is retrieving the specific washing program from an external device, for example a server that is accessible via the Internet, the latest version of the specific washing program can also be ensured.

The memory unit can comprise volatile and/or non-volatile memories, for instance. A volatile memory is a RAM (Random Access Memory) for example, which only stores a stored data item while a supply voltage is applied. A non-volatile memory is an EEPROM (Electrically Erasable Programmable Read-Only Memory) for example, in which data can be stored permanently.

The memory unit is set up in particular to store the number of washing programs, certain washing programs being stored permanently in the memory unit, for example. A washing program comprises for example different sub program steps, such as for example prewash, wash, and rinse. In particular a number of standard washing programs, such as for example an eco-program, an automatic program, a high-temperature program, and so on, are preferably stored permanently in the memory unit. Further washing programs, in particular the specific washing program, can be stored temporarily in a volatile memory for example once they have been obtained from the external device, for example.

Alternatively provision can be made for the specific washing program or specific washing programs to also be stored permanently, or at least until they are overwritten or deleted. In particular a given number of specific washing programs, for example the last five specific washing programs that were retrieved and used, can be stored in a non-volatile memory. This has the advantage that in the case of frequent use of one or more given specific washing programs, these do not have to be retrieved anew every time. The current version of the respective specific washing program can still be easily checked in this case by comparing a code, such as a version number, for example.

The memory unit can be additionally used for storing further information, such as a user guide for the dishwasher for example.

The control device can be implemented by means of hardware and/or by means of software. In the case of a hardware-based implementation the control device can be realized in the form of a computer or microprocessor for example. In the case of a software-based implementation the control device can be realized in the form of a computer program product, a function, a routine, a section of program code, or an executable object.

Furthermore, in the case of a hardware-based implementation of the control device, the memory unit can be part of the control device.

The control device is set up to carry out a washing program from the number of washing programs. Each of the sub program steps has a different sequence of control commands for example, such as heat, rotate, pump out for example, which the control device carries out. In this regard the control device is preferably set up to activate various further assemblies and/or elements of the dishwasher according to the specific washing program to be carried out. Further assemblies and/or elements of the dishwasher comprise for example a circulating pump, a heating coil, a valve, etc.

The communication unit can likewise form part of the control device. In particular the communication unit is set up to establish a communication link with other communication units. These are understood to mean in particular communication units which are arranged in other external appliances, such as for example the external household appliance or the external device. The communication unit is realized in the form of a modem or a network adapter for example, and set up for analog and/or digital data transmission. The communication unit is set up in particular for bidirectional communication so that it can both send and also receive data. The communication unit can further have a hardwired and/or a wireless interface for the communication. Moreover the communication unit can be set up for encrypted communication so that the transmitted data can not be eavesdropped upon and/or altered.

The communication unit receives status information from the external household appliance for example directly from the external household appliance or via a network, for example a local network, the Internet or also a corporate network. The status information comprises in particular information about the type of household appliance, the manufacturer of the household appliance, components of the household appliance to be cleaned and also their composition, and the maintenance condition of the household appliance. The maintenance condition comprises for example an item of data about when and/or which component of the household appliance should be cleaned.

Depending on the status information, the communication unit retrieves the specific washing program from the external device. The specific washing program is in particular a washing program whose sub program steps and/or parameters—such as the wash temperature, the cleaning agent to be used, the amount of cleaning agent, etc—are adapted to the household appliance, the component to be cleaned, and/or its composition. For example the wash temperature is correspondingly limited in the case of temperature-sensitive components, so the component is not damaged. On the other hand, in particular in the case of components that contain aluminum, the use of a cleaning agent that has an alkaline reaction (pH value over 7) can be excluded to prevent damage to those components.

Retrieve is understood to mean in particular that the communication unit establishes a communication link to the external device and requests the corresponding specific washing program according to the status information. To do this the communication unit transmits the status information, part of the status information, or a parameter produced or generated depending on the status information for example. Alternatively the communication unit can be set up to select and read out the specific washing program from a list of specific washing programs.

The retrieved specific washing program is stored in the memory unit, the control device being set up to read out and carry out the stored specific washing program.

Compared to conventional dishwashers the proposed dishwasher therefore has the advantage that for every component of an external household appliance that can be washed with the dishwasher, a specific washing program can be made available which ensures the respective component is cleaned in an optimal manner and also is not damaged or destroyed.

According to an embodiment of the dishwasher the communication unit is set up to receive the status information via a direct communication link with the external household appliance.

A direct communication link is understood in the present to mean in particular a link that is located inside a local network and does not depart from said local network. A local network is for example a private network among appliances that access the same access point by using the same subnet mask. In particular a direct link can also be a direct point-to-point link such as in the case of Bluetooth® for example.

According to a further embodiment of the dishwasher the communication unit is set up to receive the status information from the external device.

In this embodiment the external device performs twin functions: first it transmits the status information and second the specific washing program. It is advantageous in this regard that the communication unit of the dishwasher only needs to establish one communication link to the external device. Since that communication link is in any case provided for retrieving the specific washing program, the configuration effort can be smaller. In particular the configuration of a link setting for establishing the communication link to the external device can already be done during manufacturing, making it easier for the user of the dishwasher to put the dishwasher into use.

According to a further embodiment of the dishwasher an input facility is provided, which is set up to capture a user input for making the status information available.

For example users of the dishwasher can input the status information themselves via the input facility. This can be done for example by selecting predetermined input options, by free input, and/or by transmission of a file or similar Free input is understood to mean for example that the user inputs a designation of the external household appliance, for example a generic designation like oven, fume extractor hood, or microwave, or a precise type designation, comprising the product designation assigned by the manufacturer for example, by keying it in.

The input facility comprises for example a key-based entry unit, a touch screen, and/or a camera. Furthermore the input facility can also be incorporated via the communication unit. To do this for example the communication unit establishes a communication link with a mobile device of the user, the user employing the mobile device to input the status information. Advantageously in this regard a corresponding program or application is executed on the mobile device, which makes it easier for the user to input the status information.

This embodiment has the advantage in particular that external household appliances, which themselves have no communication unit for direct or indirect transmission of the status information, can be captured by users themselves and corresponding status information can be made available. By this means older household appliances in particular can also be allowed for and corresponding specific washing programs made available.

According to a further embodiment of the dishwasher the status information comprises an item of information relating to the presence of the external household appliance.

In this regard the status information simply indicates for example whether an automatic coffee machine or a fume extractor hood for example is present in the user's household or not. On the basis of this information specific washing programs, which are adapted in generic fashion to the elements of the external household appliance for example, can already be made available.

According to a further embodiment of the dishwasher the status information comprises an item of information relating to the type of the external household appliance.

The type of an external household appliance is understood to mean in particular the nature of the household appliance, the manufacturer of the household appliance, and/or a variant or product number suitable for unambiguously identifying the household appliance.

According to a further embodiment of the dishwasher the status information comprises an item of information relating to a maintenance condition of the external household appliance.

The information relating to the maintenance condition, also referred to as maintenance information, comprises for example an anticipated period until a maintenance process is due, so that for example a concrete suggestion to make use of the appropriate specific washing program can be made at the corresponding time. The suggestion can be output via a display device or via the user's smartphone for example. The maintenance information can also comprise an item of information about which current maintenance condition the external household appliance is momentarily in, for example whether a coffee holder is inserted or not. It is possible to conclude from this for example that the user now wishes to clean or wash the coffee holder.

According to a further embodiment of the dishwasher the communication unit is set up to retrieve an additional item of information from the external device in accordance with the status information, an output facility being provided that is set up to output the status information, a parameter depending on the status information, and/or the additional item of information.

In particular the output facility is a display device such as a screen for example. The screen can be arranged on the dishwasher itself or set apart from same, for example on a wall in the vicinity of the dishwasher. In particular a mobile device of the user, such as a smartphone, can also be used as an output facility however.

The additional item of information optionally retrievable from the external device comprises for example an indication of helpful accessories, special cleaning agents, a guide to setting the specific washing program, and/or relating to maintenance of the external household appliance. The parameter depending on the status information is the duration of the specific washing program for example.

According to a further embodiment of the dishwasher the specific washing program comprises a specific sequence of sub program steps, a specific washing liquor temperature, the activation of a specific hydraulic circuit, the dosing of a specific cleaning agent, and/or a predetermined envisioned arrangement of a component to be cleaned, belonging to the external household appliance.

In particular using a specific hydraulic circuit, which can also be referred to as an intensive wash zone, is advantageous. Combined with this the user is advantageously instructed to arrange the component currently to be cleaned, belonging to the external household appliance, on a shelf of the dishwasher according to the predetermined arrangement, for example by corresponding instructions being given via the output facility. This allows the dishwasher to be operated particularly efficiently during cleaning of such a component since a relatively small volume of washing liquor is sufficient. This allows a reduction in both the energy consumption and also the duration for carrying out the specific washing program.

Furthermore using a specific cleaning agent can be particularly advantageous. As already noted above the washing liquor can attack certain components chemically due to their composition. This can be avoided by this means.

According to a further embodiment of the dishwasher the communication unit is set up to establish a communication link to the external household appliance and/or to the external device via a cabled network and/or via a wireless network.

According to a second aspect a method for operating a dishwasher, more particularly a household dishwasher, comprising a control device for carrying out a washing program from a number of washing programs and a communication unit, is proposed. In a first step an item of status information relating to an external household appliance is received by way of the communication unit. In a second step a specific washing program is retrieved from an external device in accordance with the status information received. In a third step the retrieved specific washing program is added to the number of washing programs. In a fourth step the specific washing program is carried out by the control device.

The method is suitable in particular for carrying out with a dishwasher according to the first aspect.

The embodiments and features described for the proposed dishwasher apply correspondingly to the proposed method.

Furthermore a computer program product is proposed, which causes the method as explained above to be carried out on a program-controlled device.

A computer program product, such as e.g. a computer program means, can be made available or delivered for example in the form of a memory medium, such as e.g. a memory card, USB stick, CD-ROM, DVD, or also in the form of a downloadable file from a server in a network. This can be done for example by transmission of a corresponding file containing the computer program product or computer program means in a wireless communication network.

Further potential implementations of the invention also comprise combinations that are not explicitly specified, of the features or embodiments described above or below with reference to the exemplary embodiments. In this regard a person skilled in the art will also add individual aspects as improvements or additions to the respective basic form of the invention.

BRIEF DESCRIPTION OF THE DRAWINGS

Further advantageous embodiments and aspects of the invention form the subject of the dependent claims and also the exemplary embodiments of the invention described below. In the following the invention is described in detail on the basis of preferred embodiments with reference to the enclosed figures.

DETAILED DESCRIPTION OF EXEMPLARY EMBODIMENTS OF THE PRESENT INVENTION

In the figures identical or functionally identical elements are labeled with the same reference symbols unless otherwise indicated.

Figure 1:
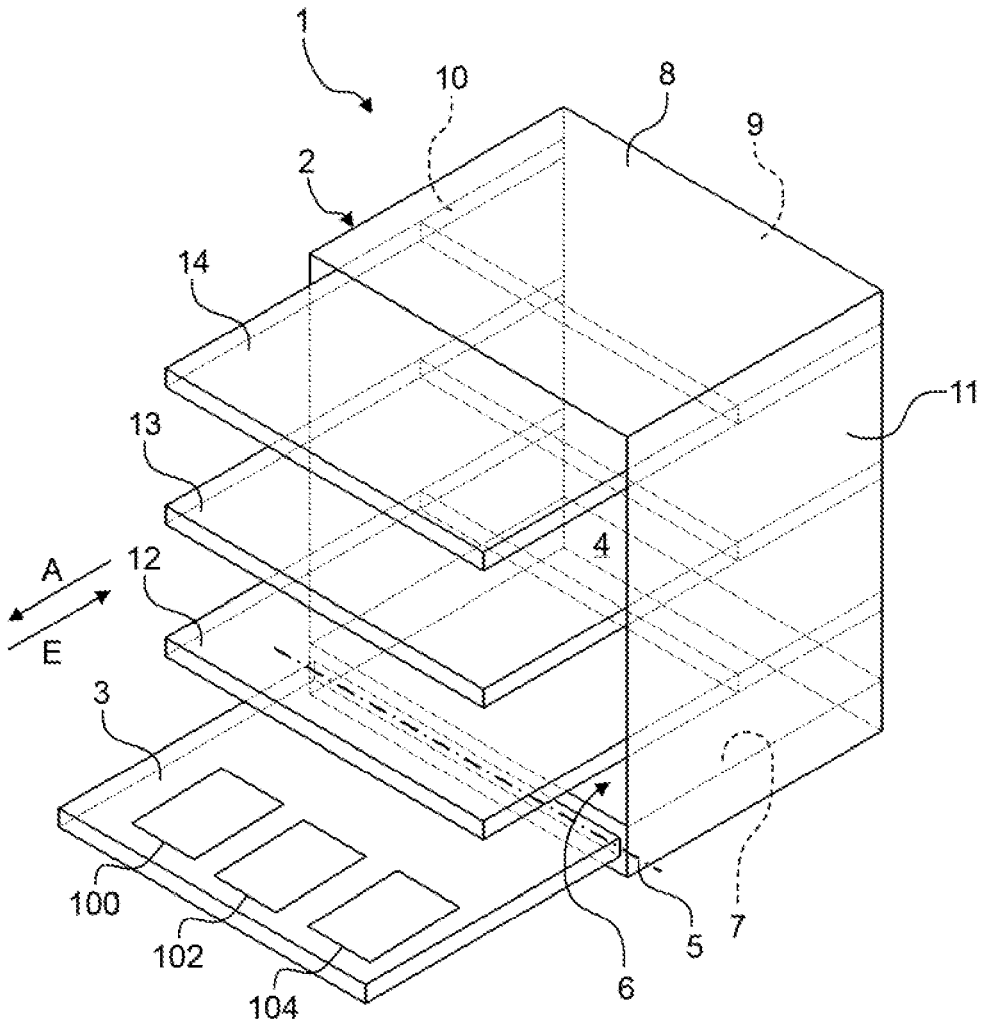
FIG. 1 shows a schematic perspective view of an exemplary embodiment of a dishwasher.

FIG. 1 shows a schematic perspective view of an embodiment of a dishwasher 1. Here the dishwasher 1 is realized in the form of a household dishwasher 1. The household dishwasher 1 comprises a washing container 2, which can be closed by means of a door 3, which is in particular watertight. To this effect a sealing means (not shown) can be provided between the door 3 and the washing container 2.

The washing container 2 is preferably cuboid in shape. The washing container 2 can be arranged in a casing of the household dishwasher 1. The washing container 2 and the door 3 can form a washing compartment 4 for washing articles.

In FIG. 1 the door 3 is shown in its open position. The door 3 can be closed or opened by a pivoting movement around a pivoting axis 5 provided at the lower end of the door 3. A loading aperture 6 of the washing container 2 can be closed or opened with the aid of the door 3. The washing container 2 has a bottom 7, a top 8 situated opposite the bottom 7, a rear wall 9 arranged opposite the closed door 3, and two side walls 10, 11 arranged opposite each other. The bottom 7, the top 8, the rear wall 9, and the side walls 10, 11 can be fabricated from stainless steel sheet for example. Alternatively for example the bottom 7 can be fabricated from a plastic material.

The household dishwasher 1 further has at least one shelf 12, 13, 14. Advantageously several shelves, for example three 12, 13, 14 can be provided, the shelf 12 possibly being a lower shelf or a lower basket, the shelf 13 an upper shelf or an upper basket, and the shelf 14 a cutlery shelf. As FIG. 1 further shows the shelves 12, 13, 14 are arranged above each other in the washing container 2. Each shelf 12 to 14 can be optionally moved in to the washing container 2 or out of same. In particular each shelf 12, 13, 14 can be pushed in to the washing container 2 in an insert direction E and pulled out of the washing container 2 in an extract direction A, opposite to the insert direction E.

The household dishwasher 1 has a control device 100 arranged on the door 3. A communication unit 102 and memory unit 104 are further arranged on the door 3. These two units 102, 104 are shown separate from the control device 100 here but can also be integrated in to same. The memory unit 104 is set up to store data, a number of washing programs being stored in the memory unit 104 in particular. To carry out a washing program the control device 100 accesses the memory unit 104 for example, reads out the washing program to be carried out currently, and carries it out correspondingly. The memory unit 104 has at least one memory section (not shown) that is rewritable, that is to say data written there can be deleted and/or overwritten and replaced by new data. The communication unit 102 is set up for bidirectional communication with further communication units that are arranged in external appliances in particular (see FIG. 2).

The communication unit 102 is set up in particular to retrieve a specific washing program SP from an external device 210 in accordance with an item of status information S (see FIG. 2) relating to an external household appliance 200, and to store the said washing program in the memory unit 104. The household dishwasher 1 is therefore set up to make a specific washing program SP available for every external household appliance 201, 202, 203, or every component 205 (see FIG. 3) of an external household appliance 201, 202, 203 that can be washed using the household dishwasher 1 for the purpose of maintenance or cleaning. It is therefore possible to ensure that the component 205 is not damaged or destroyed.

Figure 2:
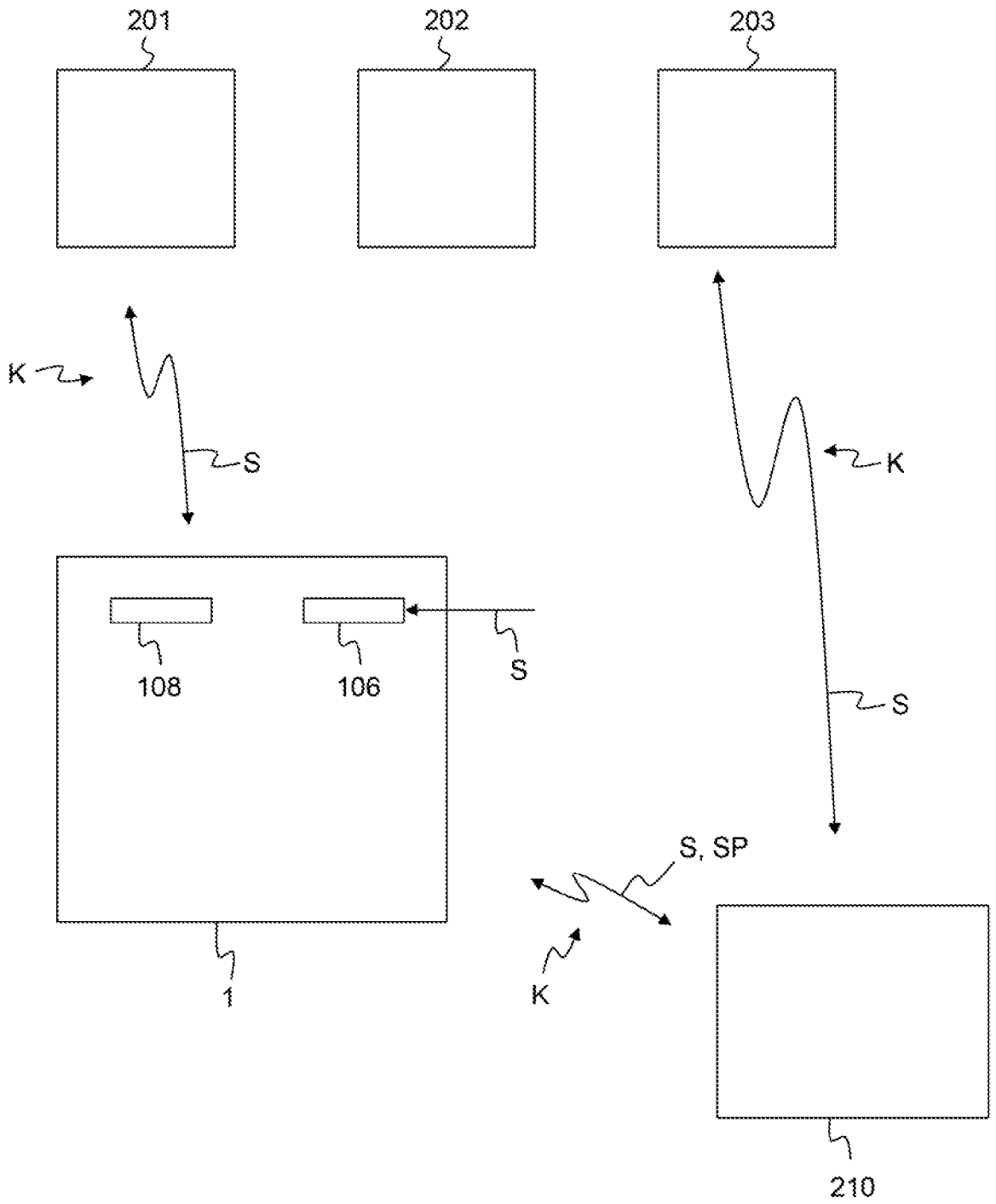
FIG. 2 shows a further exemplary embodiment of a dishwasher and various external appliances in schematic form.

The more detailed functioning of the household dishwasher 1 will now be explained with reference to FIG. 2. Alongside the household dishwasher 1, which in particular has all the features of the exemplary embodiment in FIG. 1 and also an input facility 106 and an output facility 108, FIG. 2 shows three external household appliances 201, 202, 203 and an external device 210.

The household dishwasher 1 establishes a direct communication link K to one of the external household appliances 201, for example an automatic coffee machine, in particular by using the communication unit 102 (see FIG. 1). This is possible in particular if the automatic coffee machine 201 likewise has a communication unit. The household dishwasher 1 receives an item of status information S from the automatic coffee machine 201 via this communication link K. In this example the status information S comprises an unambiguous designation of the type of automatic coffee machine 201 so that the manufacturer, and in particular the components 205 (see FIG. 3) that are envisioned for disassembly for regular maintenance and cleaning, can be determined on the basis of the status information S. The status information S further comprises the information for example that the automatic coffee machine 201 is precisely in a maintenance mode, in which the coffee holder has currently been removed for cleaning.

The household dishwasher 1 likewise establishes a communication link K to an external device 210, which is set up in particular as a server for making specific washing programs SP available. Via this communication link K the household dishwasher 1 can retrieve, in particular depending on the status information S that it received direct from the automatic coffee machine 201, a specific washing program SP that is particularly suitable for cleaning a component 205, in the present case for example the coffee holder of the automatic coffee machine 201. Via this communication link K the household dishwasher 1 can further retrieve additional detailed information relating to the automatic coffee machine 201, and make it available to the user via the output facility 108 for example.

A further household appliance 202 is realized for example in the form of an oven, which has no communication unit. Consequently direct communication, in particular the transmission of an item of status information S relating to the oven 202 is not possible. In this case users of a household dishwasher 1 can make the status information S available themselves, for example via the input facility 106. In this case the input facility 106 is realized in the form of a keypad for example. Users of a household dishwasher 1 can input the status information S, for example by corresponding operation of the keypad 106 in conjunction with information reproduced by the output facility 108, which is realized for example in the form of an LCD screen. For example a selection list is displayed on the LCD screen 108, which the user scrolls through by using the input facility 106, and selects or inputs the list entry being searched for. Then for example various specific washing programs SP, which can be retrieved from the server 210 and are specifically suitable for the oven 202 or for various components 205 of the oven 202, can be suggested.

A third household appliance 203, for example a fume extractor hood, establishes a direct communication link K with the server 210. The fume extractor hood 203 transmits an item of status information S to the server 210 via this communication link K. In this case for example the household dishwasher 1 receives the status information S from the server 210 and/or retrieves it from there. Once again, a specific washing program SP for components 205 of the fume extractor hood 203 can be retrieved from the server 210 in accordance with the status information S.

Moreover additional information relating to the external household appliances 201, 202, 203, and also the household dishwasher 1, can be retrieved via the communication link K of the household dishwasher 1 with the server 210. For example provision can be made for specific replacement parts, accessories, and/or cleaning agents to be ordered directly via the communication link K.

Figure 3:
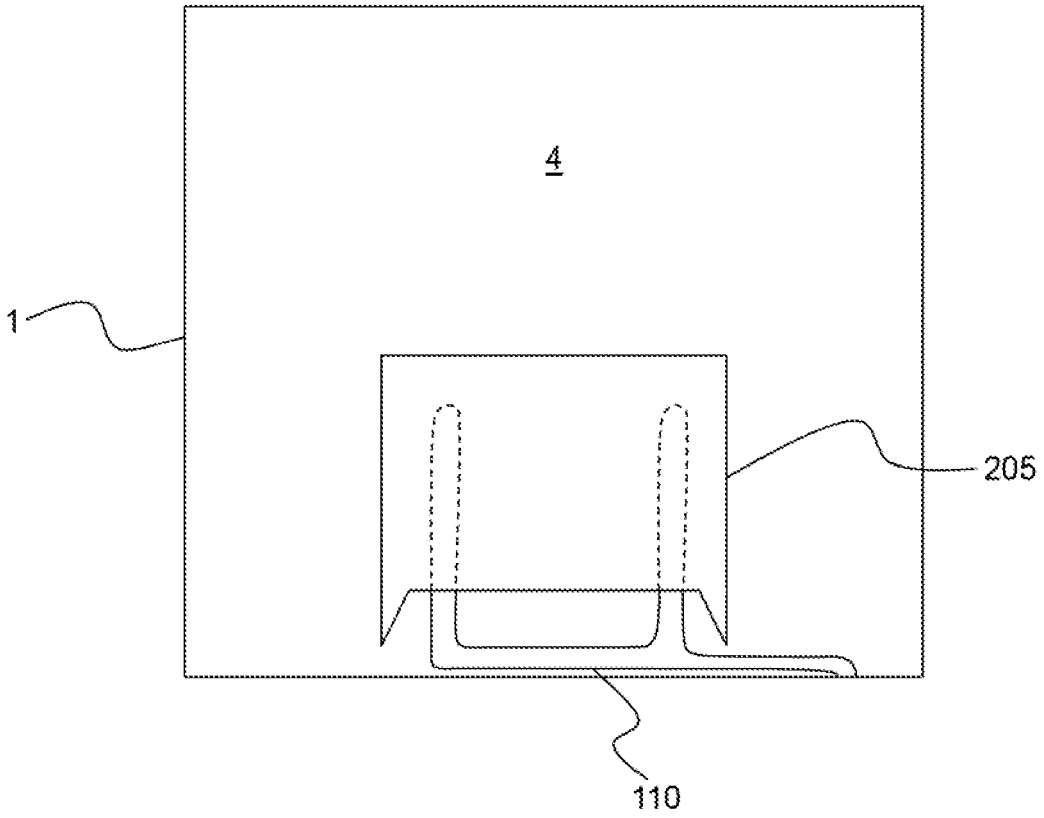
FIG. 3 shows a schematic view of a further exemplary embodiment of a dishwasher.

FIG. 3 shows a schematic view of a further exemplary embodiment of a dishwasher 1. The dishwasher 1 is again realized in the form of a household dishwasher 1 and optionally has all the features of the household dishwashers shown in FIG. 1 and/or FIG. 2.

In particular the household dishwasher shown in FIG. 3 has a specific hydraulic system 110. The specific hydraulic system 110 can be permanently pre-installed or alternatively obtainable as a special accessory. In this example the specific hydraulic system 110 is set up in particular to clean a component 205, here shown as a coffee holder by way of example, of an external household appliance 201, 202, 203. In this regard the specific hydraulic system 110 is shaped such that the coffee holder 205 is optimally supported, and that the said coffee holder can be washed in particular from the inside, especially thoroughly, but at the same time also gently. In particular the specific hydraulic system 110 has the advantage that the energy and water consumption for the specific washing program SP to clean the coffee holder 205 can be substantially reduced compared to a conventional washing program. Furthermore for example the washing liquor temperature can be kept low so that the coffee holder 205 does not suffer any damage due to washing in the household dishwasher.

Figure 4:
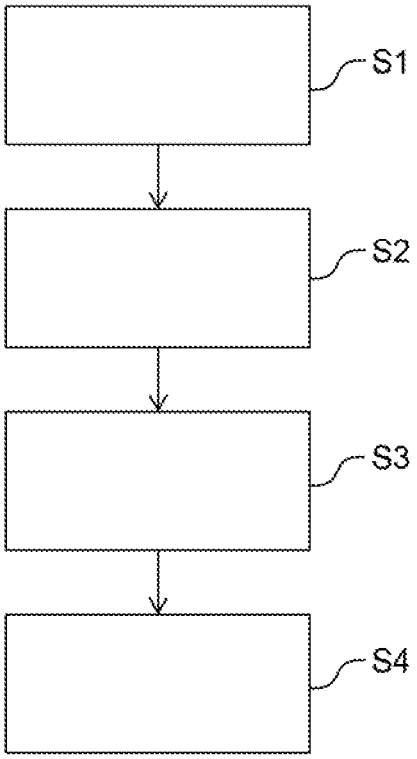
FIG. 4 shows a schematic block diagram of an exemplary embodiment of a method for operating a dishwasher.

FIG. 4 shows a schematic block diagram of an exemplary embodiment of a method for operating a dishwasher 1, for example a household dishwasher according to one of FIGS. 1-3. The household dishwasher 1 is operated for example by a user in a household with various external household appliances 201, 202, 203 (see FIG. 2), such as an automatic coffee machine 201, an oven 202, and a fume extractor hood 203. The filter inserts of the fume extractor hood 203 are dirty for example, which the fume extractor hood 203 can detect by sensor technology. The fume extractor hood 203 has a communication unit for example and is situated in a direct communication link K with the communication unit 102 of the household dishwasher 1.

In a first step S1 of the method the communication unit 102 receives an item of status information S from the fume extractor hood 203. The status information S comprises for example firstly information about the type, manufacturer, and model of the fume extractor hood 203, and secondly information about the maintenance condition, that is to say in the present case in particular that the filter inserts are dirty and should be cleaned.

In a second step S2 the communication unit 102 retrieves a specific washing program SP from an external device 210 (see FIG. 2) in accordance with the status information S received. In particular the specific washing program SP can be made available by the manufacturer of the household dishwasher 1 taking account of the properties of the fume extractor hood 203. Alternatively the washing program can also be made available by the manufacturer of the fume extractor hood 203.

In a third step S3 the retrieved specific washing program SP is stored in the memory unit 104.

In a fourth step S4 the stored specific washing program SP is carried out by way of the control device 100. In particular the specific washing program SP is not executed until after corresponding activation by the user, for example if the said user has put in a possibly required specific cleaning agent for the specific washing program SP and inserted the filter inserts of the fume extractor hood 203 on a shelf 12, 13, 14.

The method outlined can be applied correspondingly to other external household appliances 201, 202, 203 and the most diverse components 205.

Although the present invention has been described with reference to exemplary embodiments, it can be modified in numerous ways. In particular already existing devices of the user, such as a smartphone and/or tablet, can be used for interacting with the user by way of a suitable application. To this extent the application can be regarded as a user interface relocated from the dishwasher, by means of which the dishwasher can be controlled. It is conceivable in this regard for indications of maintenance measures that are due soon to be given, and also instructions for carrying out such maintenance measures to be held ready, and suggestions for useful accessories, and in particular specific cleaning agents, and further such items, to be presented by means of the application, depending on the status information. Furthermore an augmented reality display is possible with the aid of such a mobile device, if it has a camera. An image of the dishwasher is then taken with the camera for example, which image can be output on the screen as a video image. By means of an overlay the video image additionally shows how the user arranges a given component to be cleaned optimally in the dishwasher. This supports the user in a very intuitive and easily understandable manner when using the dishwasher.

The invention claimed is:

1. A dishwasher, comprising:

a washing compartment;

a memory unit for storing a number of washing programs;

a control device configured to carry out a washing program from the number of washing programs; and a communication unit configured to retrieve a specific washing program from an external device in accordance with a status information relating to a removable component of an external household appliance, the removable component of the external household appliance being configured to be removed from the external household appliance and disposed in the washing compartment of the dishwasher and washed, and the communication unit being configured to store the retrieved specific washing program in the memory unit, said control device carrying out the stored specific washing program;

wherein the communication unit receives the status information relating to the removable component from the external household appliance, directly or via a network; and wherein said status information includes at least one of a type of said external household appliance, a manufacturer of said external household appliance, information on said component of said external household appliance to be cleaned, a composition of said component of said external household appliance, or a maintenance condition of said external household appliance.

2. The dishwasher of claim 1, constructed in the form of a household dishwasher.

3. The dishwasher of claim 1, wherein the communication unit is configured to receive the status information via a direct communication link with the external household appliance.

4. The dishwasher of claim 1, wherein the communication unit is configured to receive the status information from the external device.

5. The dishwasher of claim 1, further comprising an input facility configured to capture a user input for making the status information available.

6. The dishwasher of claim 1, wherein the status information comprises an item of information relating to a presence of the external household appliance.

7. The dishwasher of claim 1, wherein the status information comprises an item of information relating to a type of the external household appliance.

8. The dishwasher of claim 1, wherein the status information comprises an item of information relating to a maintenance condition of the external household appliance.

9. The dishwasher of claim 1, wherein the communication unit is configured to retrieve an additional item of information from the external device in accordance with the status information, and further comprising an output facility configured to output at least one of the status information, a parameter depending on the status information, and the additional item of information.

10. The dishwasher of claim 1, wherein the specific washing program comprises at least one of a specific sequence of sub program steps, a specific washing liquor temperature, activation of a specific hydraulic circuit, dosing of a specific cleaning agent, and a predetermined envisioned arrangement of a component to be cleaned, belonging to the external household appliance.

11. The dishwasher of claim 1, wherein the communication unit is configured to establish a communication link to the external household appliance and/or a communication link to the external device via a cabled network and/or a communication link via a wireless network.

12. A method for operating a dishwasher, comprising:

receiving, from an external household appliance, an item of status information relating to a removable component of the external household appliance by way of a communication unit of the dishwasher, the removable component of the external household appliance being configured to be removed from the external household appliance and disposed in a washing compartment of the dishwasher and washed, wherein the communication unit receives the item of status information from the external household appliance, directly or via a network;

wherein said status information includes at least one of a type of said external household appliance, a manufacturer of said external household appliance, information on said component of said external household appliance to be cleaned, a composition of said component of said external household appliance, or a maintenance condition of said external household appliance retrieving a specific washing program from an external device in accordance with the status information received relating to the removable component of the external household appliance;

storing the retrieved specific washing program in a memory unit; and carrying out the specific washing program by way of a control device.

13. A computer program product for operating a dishwasher, comprising a computer program embodied in a non-transitory computer readable medium, wherein the computer program, when loaded into a program-controlled device and executed by the program-controlled device, causes the program-controlled device to perform the steps of:

receiving, from an external household appliance, an item of status information relating to a removable component of the external household appliance by way of a communication unit of the dishwasher, the removable component of the external household appliance being configured to be removed from the external household appliance and disposed in a washing compartment of the dishwasher and washed, wherein the communication unit receives the item of status information from the external household appliance, directly or via a network, wherein said status information includes at least one of a type of said external household appliance, a manufacturer of said external household appliance, information on said component of said external household appliance to be cleaned, a composition of said component of said external household appliance, or a maintenance condition of said external household appliance;

retrieving a specific washing program from an external device in accordance with the status information received, storing the retrieved specific washing program in a memory unit, and carrying out the specific washing program by way of a control device.

14. The dishwasher of claim 1, wherein the component comprises at least one of a back plate or a grill rack for an oven, a glass turntable for a microwave, a filter insert for a fume extractor hood, a water tank and/or a coffee holder of a coffee machine, or a strainer insert of a deep fryer.

15. A dishwasher, comprising:

a washing compartment;

a memory unit for storing a number of washing programs;

a control device configured to carry out a washing program from the number of washing programs; and a communication unit configured to retrieve a specific washing program from an external device in accordance with a status information relating to a removable component of an external household appliance, the external device which provides the specific washing program from a plurality of washing programs related to a plurality of components of a plurality of external household appliances; and wherein the removable component of the external household appliance is configured to be removed from the external household appliance and disposed in the washing compartment of the dishwasher and washed, and the communication unit is configured to store the retrieved specific washing program in the memory unit, said control device carrying out the stored specific washing program.

* * * * *